US009756927B2

(12) United States Patent
Auclair et al.

(10) Patent No.: US 9,756,927 B2
(45) Date of Patent: Sep. 12, 2017

(54) MOUNTING SYSTEM FOR PORTABLE ELECTRONIC DEVICE

(75) Inventors: Martin Auclair, Waterloo (CA); Fletcher Rothkopf, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 131 days.

(21) Appl. No.: 13/307,407

(22) Filed: Nov. 30, 2011

(65) Prior Publication Data

US 2013/0135796 A1 May 30, 2013

(51) Int. Cl.

| | |
|---|---|
| ***H05K 7/00*** | (2006.01) |
| ***G06G 1/16*** | (2006.01) |
| ***A45F 5/00*** | (2006.01) |
| ***A45C 11/00*** | (2006.01) |
| ***A45F 5/02*** | (2006.01) |

(52) U.S. Cl.

CPC ..... *A45F 5/00* (2013.01); *A45C 11/00* (2013.01); *A45F 5/02* (2013.01); *A45F 5/021* (2013.01); *A45C 2011/001* (2013.01); *A45C 2011/002* (2013.01); *A45C 2011/003* (2013.01); *A45F 2005/006* (2013.01); *A45F 2200/0508* (2013.01); *A45F 2200/0516* (2013.01); *A45F 2200/0525* (2013.01); *A45F 2200/0533* (2013.01); *Y10T 29/49826* (2015.01)

(58) Field of Classification Search

CPC ..... G06F 1/1601; G06F 1/16
USPC ..... 345/156, 157, 168, 169; 248/917–924
See application file for complete search history.

(56) References Cited

U.S. PATENT DOCUMENTS

| | | | | |
|---|---|---|---|---|
| 3,883,861 | A | 5/1975 | Heartz | |
| 4,369,439 | A | 1/1983 | Broos | |
| 4,506,354 | A | 3/1985 | Hansen | |
| 5,010,536 | A | 4/1991 | Wanger et al. | |
| 5,059,959 | A | 10/1991 | Barry | |
| 5,317,105 | A | 5/1994 | Weber | |
| 5,342,991 | A | 8/1994 | Xu et al. | |
| 5,664,292 | A * | 9/1997 | Chen | 24/3.11 |
| 5,770,898 | A | 6/1998 | Hannigan et al. | |
| 5,959,612 | A | 9/1999 | Breyer et al. | |

(Continued)

FOREIGN PATENT DOCUMENTS

| | | |
|---|---|---|
| CN | 201898231 | 7/2011 |
| JP | 58112263 | 7/1983 |

(Continued)

OTHER PUBLICATIONS

Kwon et al., "Haptic Interferences for Mobile Devices: a Survey of the State of the Art," Telerobotics and Control Laboratory, KAIST (Korea Advanced Institute of Science and Technology, Korea, Dec. 11, 2007.

*Primary Examiner* — Jerry Wu
(74) *Attorney, Agent, or Firm* — Downey Brand LLP

(57) ABSTRACT

Methods and apparatuses are disclosed for fabricating an electronic device with an integrated railing system that detachably couples mounting hardware to the electronic device. By selectively detaching the mounting hardware, the electronic device may be made more compact and portable. In some embodiments, the railing system is fabricated substantially contemporaneous to fabricating the electronic device, such as by extrusion of the railing and the electronic device together. This fabrication approach may reduce the overall cost and complexity of manufacturing the railing system.

23 Claims, 22 Drawing Sheets

(56) References Cited

U.S. PATENT DOCUMENTS

| | | | |
|---|---|---|---|
| 5,975,953 | A | 11/1999 | Peterson |
| 6,130,663 | A | 10/2000 | Null |
| 6,198,470 | B1 | 3/2001 | Agam et al. |
| 6,216,999 | B1 | 4/2001 | Olson et al. |
| 6,310,769 | B1 | 10/2001 | Johnson et al. |
| 6,313,825 | B1 | 11/2001 | Gilbert |
| 6,337,678 | B1 | 1/2002 | Fish |
| 6,429,846 | B2 | 8/2002 | Rosenberg et al. |
| 6,519,138 | B1 | 2/2003 | Olson et al. |
| 6,713,672 | B1 | 3/2004 | Stickney |
| 6,800,805 | B2 | 10/2004 | Deguchi |
| 6,987,466 | B1 | 1/2006 | Welch et al. |
| 7,009,838 | B2 | 3/2006 | Roh |
| 7,075,793 | B2 | 7/2006 | Le et al. |
| 7,113,196 | B2 | 9/2006 | Kerr |
| 7,125,287 | B1 | 10/2006 | Chou et al. |
| 7,222,753 | B2 | 5/2007 | Hayduk |
| 7,280,353 | B2 | 10/2007 | Wendel et al. |
| 7,345,677 | B2 | 3/2008 | Ing et al. |
| 7,411,581 | B2 | 8/2008 | Hardie-Bick |
| 7,470,862 | B2 | 12/2008 | Lin et al. |
| 7,470,866 | B2 | 12/2008 | Dietrich et al. |
| 7,473,139 | B2 | 1/2009 | Barringer et al. |
| 7,499,286 | B2 | 3/2009 | Berke et al. |
| 7,511,711 | B2 | 3/2009 | Ing et al. |
| 7,545,636 | B2 | 6/2009 | Wobig et al. |
| 7,575,481 | B1 | 8/2009 | Liu |
| 7,620,316 | B2 | 11/2009 | Boillot |
| 7,656,393 | B2 | 2/2010 | King et al. |
| 7,710,397 | B2 | 5/2010 | Krah et al. |
| 7,725,288 | B2 | 5/2010 | Boillot |
| 7,834,855 | B2 | 11/2010 | Hotelling et al. |
| 7,844,310 | B2 | 11/2010 | Anderson |
| 7,845,953 | B2 | 12/2010 | Brock et al. |
| 7,852,369 | B2 | 12/2010 | Cutler et al. |
| 7,884,315 | B2 | 2/2011 | Andre et al. |
| 7,924,175 | B2 | 4/2011 | Gitzinger et al. |
| 8,098,233 | B2 | 1/2012 | Hotelling et al. |
| 8,120,902 | B2 | 2/2012 | Dozier et al. |
| 8,204,561 | B2 * | 6/2012 | Mongan et al. ..... 455/575.8 |
| 8,913,377 | B2 | 12/2014 | Furuta |
| 2004/0129515 | A1 | 7/2004 | Murakami |
| 2004/0238195 | A1 | 12/2004 | Thompson |
| 2006/0082518 | A1 * | 4/2006 | Ram ..... 345/1.1 |
| 2006/0197753 | A1 | 9/2006 | Hotelling |
| 2007/0263351 | A1 | 11/2007 | Ho et al. |
| 2008/0103637 | A1 | 5/2008 | Bliven et al. |
| 2009/0002328 | A1 | 1/2009 | Ullrich et al. |
| 2009/0052715 | A1 | 2/2009 | Zhang et al. |
| 2009/0173533 | A1 | 7/2009 | Brock et al. |
| 2009/0173534 | A1 | 7/2009 | Keiper et al. |
| 2009/0244836 | A1 | 10/2009 | Leng et al. |
| 2010/0044067 | A1 | 2/2010 | Wong et al. |
| 2010/0122439 | A1 | 5/2010 | Britton et al. |
| 2010/0301755 | A1 | 12/2010 | Pance et al. |
| 2010/0306683 | A1 | 12/2010 | Pance et al. |
| 2011/0037624 | A1 | 2/2011 | Pance et al. |
| 2011/0037734 | A1 | 2/2011 | Pance et al. |
| 2011/0038114 | A1 | 2/2011 | Pance et al. |
| 2011/0043227 | A1 | 2/2011 | Pance et al. |
| 2011/0102991 | A1 * | 5/2011 | Sullivan ..... 361/679.02 |
| 2011/0119973 | A1 | 5/2011 | Andre et al. |
| 2011/0175813 | A1 | 7/2011 | Sarwar et al. |
| 2011/0235252 | A1 * | 9/2011 | Miyazaki et al. ..... 361/679.01 |
| 2012/0031788 | A1 * | 2/2012 | Mongan et al. ..... 206/320 |
| 2014/0071611 | A1 | 3/2014 | Nguyen et al. |

FOREIGN PATENT DOCUMENTS

| | | | | |
|---|---|---|---|---|
| JP | 2002207985 A | * | 7/2002 | ..... G06K 19/077 |
| WO | WO2005/083547 | | 9/2005 | |
| WO | WO2007/083894 | | 7/2007 | |

* cited by examiner

MOUNTING SYSTEM FOR PORTABLE ELECTRONIC DEVICE

BACKGROUND

I. Technical Field

The present invention relates generally to portable electronic devices and, more particularly, to portable electronic devices with integrated mounting systems.

II. Background Discussion

Electronic devices are ubiquitous in society and can be found in everything from portable cell phones to wristwatches. Because many of these electronic devices are portable, users often take these portable electronic devices wherever they go. A user may not always be able to physically hold these portable electronic devices, and as such, there is often a need for mounting hardware for these portable electronic devices. For example, some portable electronic devices, such as global positioning systems, are often mounted to the dash of an automobile. Other electronic devices, such as portable music players, may be mounted to a user's clothing or body. Unfortunately, conventional mounting hardware for these portable electronic devices is often bulky, cumbersome, and not aesthetically pleasing to the user. In addition to being bulky, cumbersome, not aesthetically pleasing, the mounting hardware for electronic devices can be both difficult and expensive to manufacture.

Accordingly, a mounting system for a portable electronic device that addresses one or more of these problems is disclosed.

SUMMARY

Methods and apparatuses are disclosed for fabricating an electronic device with an integrated railing system that detachably couples mounting hardware to the electronic device. By selectively detaching the mounting hardware, the electronic device may be made more compact and portable. In some embodiments, the railing system is fabricated substantially contemporaneous to fabricating the electronic device, such as by extrusion of the railing and the electronic device together. This fabrication approach may reduce the overall cost and complexity of manufacturing the railing system.

Some embodiments may include an electronic device capable of being mounted. The electronic device comprises a main body that includes electronic circuitry, a user interface, and a rail. The electronic device further comprises a clip detachably coupled to the rail, the clip includes an insert, an outer shell, and a tongue. The electronic device further comprises a catch pivotally coupled to the tongue, the catch includes a tab.

Other embodiments include a portable electronic device that comprises a main body comprising a rail, where the rail is integrally formed in the main body through an extrusion process, and a clip detachably coupled to the rail.

Still other embodiments include a method of manufacturing a mounting system for an electronic device. The method comprises extruding a first raw stock material to form an insert, etching a recess in the insert, cutting the insert so that its length is substantially equal to at least one dimension of a shell, stamping a second raw stock material to form a shell, fastening a stop to the shell, and fastening the insert to the shell such that the recess is substantially aligned with the stop.

BRIEF DESCRIPTION OF THE DRAWINGS

The use of the same reference numerals in different drawings indicates similar or identical items.

DETAILED DESCRIPTION OF THE INVENTION

Methods and apparatuses are disclosed for fabricating an electronic device with an integrated railing system that detachably couples mounting hardware to the electronic device. By selectively detaching the mounting hardware, the electronic device may be made more compact and portable. In some embodiments, the railing system is fabricated substantially contemporaneous to fabricating the electronic device, such as by extrusion of the railing and the electronic device together. This fabrication approach may reduce the overall cost and complexity of manufacturing the railing system.

Although one or more of the embodiments disclosed herein may be described in detail with reference to a particular electronic device, the embodiments should not be interpreted or otherwise used as limiting the scope of the disclosure, including the claims. In addition, one skilled in the art will understand that the following description has broad application. Thus, the discussion of any embodiment is meant only to be exemplary and is not intended to suggest that the scope of the disclosure, including the claims, is limited to these embodiments.

Figure 1A:
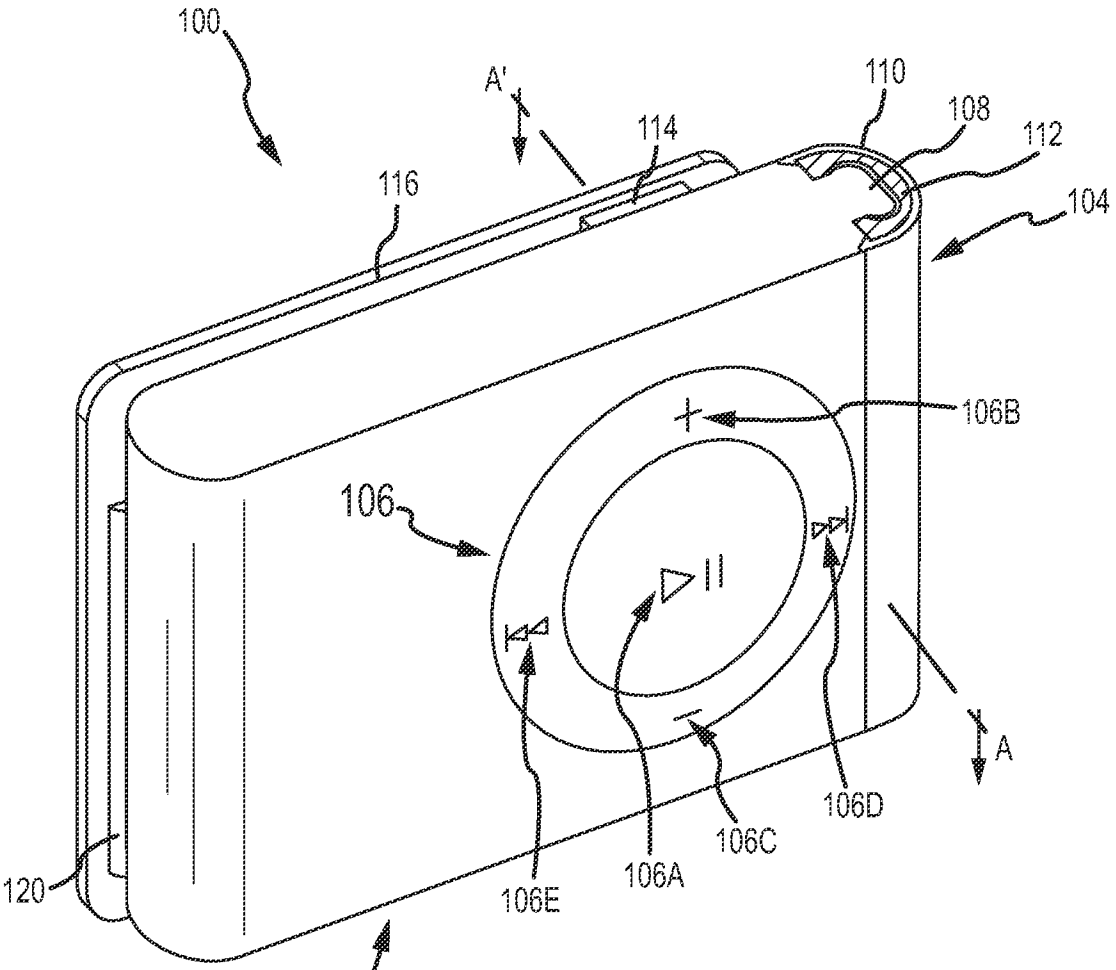
FIG. 1A shows a front perspective view of an electronic device.
Figure 1B:
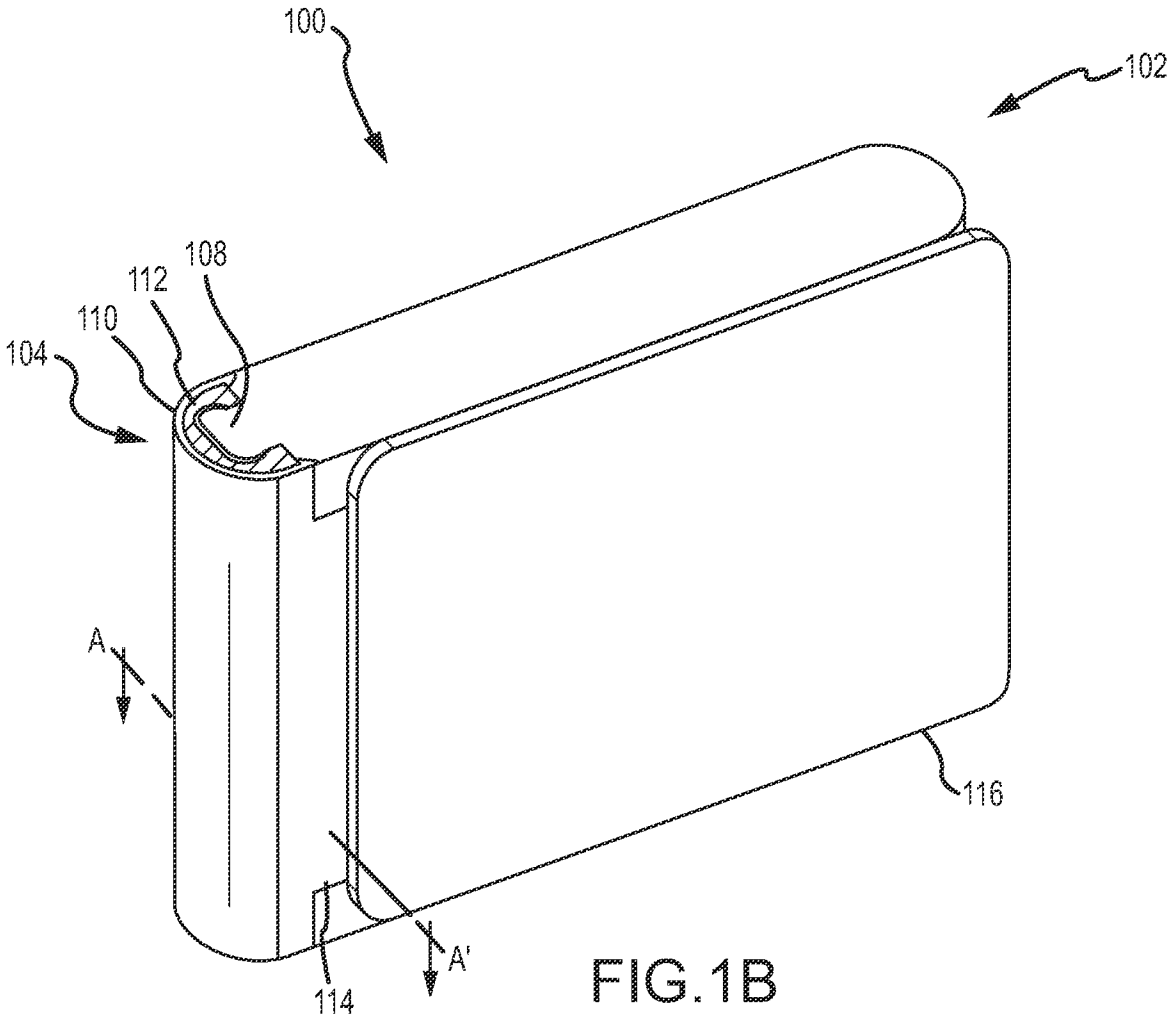
FIG. 1B shows a rear perspective view of the electronic device.

FIGS. 1A and 1B illustrate front and rear perspective views of an electronic device 100. Although the electronic device 100 is illustrated as an iPod Shuffle® portable media player from Apple Computer Inc., the electronic device 100 may take many different forms. For example, other embodiments of the electronic device 100 include a portable camera, a cell phone, an electronic tablet, a laptop computer, a desk top computer, as well as computer peripheral devices (such as a computer mouse and/or a keyboard) to name but a few.

Referring to FIGS. 1A and 1B, FIG. 1A shows a front perspective view of the electronic device 100 and FIG. 1B shows a rear perspective view of the electronic device 100. As shown in FIGS. 1A and 1B, the electronic device 100 includes a main body portion 102 that is detachably coupled to a fastener, catch, clasp, or clip 104. The main body portion 102 may include one or more electronic components (not specifically shown) to perform a desired electronic function. In the case of the illustrated embodiment, the desired electronic function is organizing, transmitting, manipulating, and/or reviewing audio files, however, the precise electronic function will vary with each embodiment.

As shown in FIG. 1A, the front side of the main body 102 may include an interface 106 that serves as an interaction point between the electronic device 100 and a user. In the illustrated embodiment, the interface 106 is shown as multiple depressible switches or buttons 106A-E, where button 106A controls play and pause control of the audio, buttons 106B and 106C control the volume, and buttons 106D and 106E control which audio track is playing. Of course, other embodiments exist where the interface 106 is implemented differently, such as by using a touch screen.

Referring still to FIGS. 1A and 1B, the clip 104 detachably couples to the main body 102 via a track or rail 108 formed in the main body 102. In some embodiments, the rail 108 may be integrally formed in the main body 102 substantially contemporaneous to forming the main body 102 itself. For example, in some embodiments, the rail 108 may be extruded such that raw stock for the main body 102 is pushed through a die whose cross section includes a portion that matches the cross sectional pattern of the rail 108. This raw stock used for the main body 102 and rail 108 may include aluminum or stainless steel (to name only a few possibilities). Forming the rail 108 as part of the overall extrusion process used in forming the main body 102 reduces the overall cost and complexity of manufacturing the rail 108. Additionally, if the raw stock is anodized aluminum, then an aesthetically pleasing version of the rail 108 may be formed without further processing.

Furthermore, although extrusion is discussed herein as a process for manufacturing the rail 108 and/or main body 102, a variety of metal shaping processes are possible. For example, the rail 108 and/or main body 102 may be formed by roll forming, forging, and injection molding to name but a few of the alternatives.

Also, while the rail 108 is illustrated herein as laterally disposed along one side of the main body 102, other embodiments are possible where the rail 108 is disposed along multiple sides of the main body 102. In these embodiments, the clip 104 may be dual sided with the ability to engage the rails on multiple sides of the main body 102.

Figure 1C:
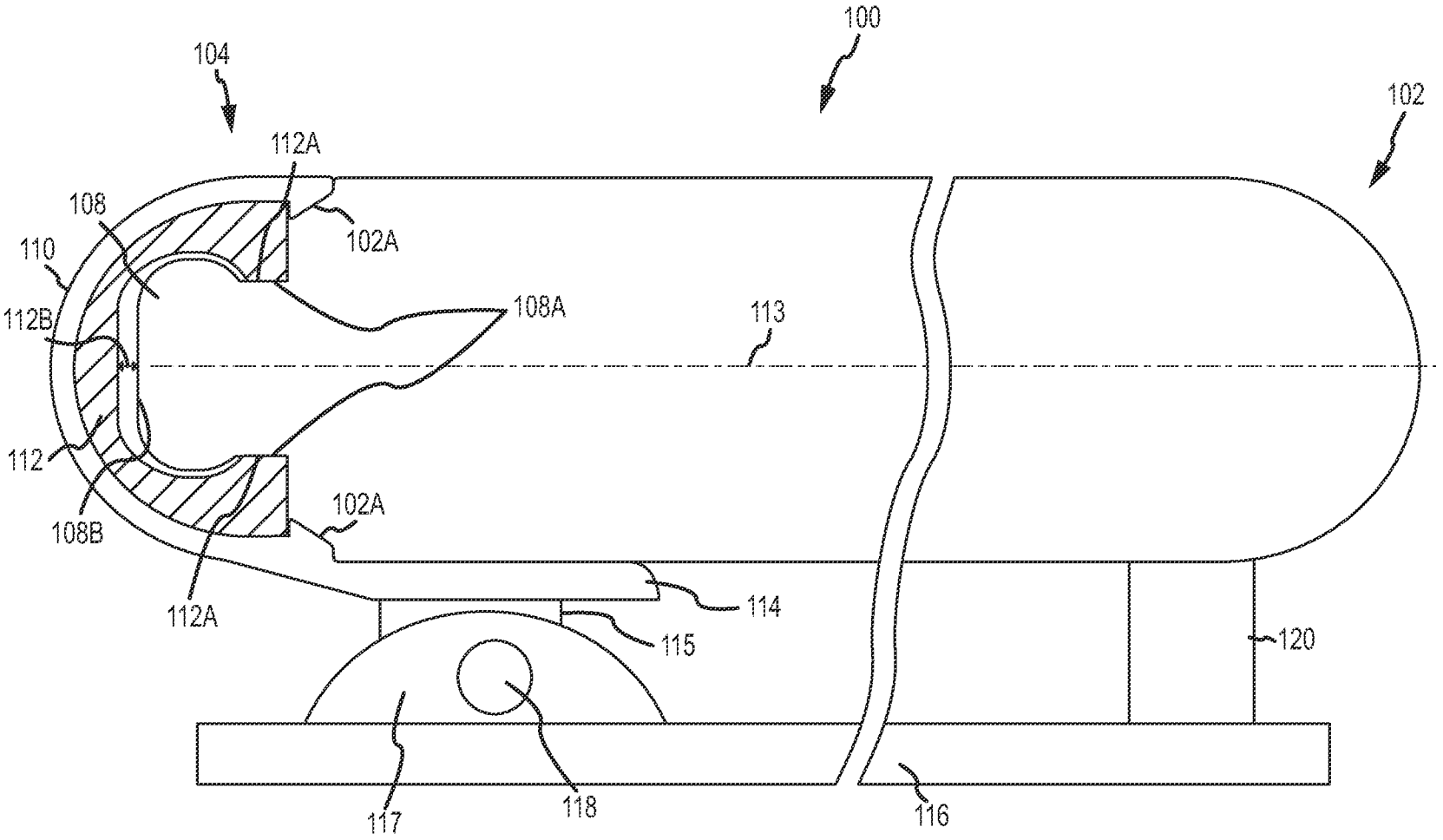
FIG. 1C shows a top down view of the electronic device.

FIG. 1C illustrates a top down view of the electronic device 100 with the clip 104 detachably coupled to the main body 102 via the rail 108. Referring now to FIG. 1C, the clip 104 includes an outer structure, framework, or shell 110. In the illustrated embodiment, the shell 110 is metallic, and may be manufactured from the same metal as the main body 102, such as aluminum or stainless steel. In other embodiments, the shell 110 may be manufactured using pure plastic, plastic mixed with metal, and/or thermoplastic polymers. The clip 104 also includes a layer or insert 112 fitted to the interior of the shell 110. Additional detail regarding the fitment of the insert 112 to the interior of the shell 110 will be described below with regard to FIGS. 3A-B, 4, and 5. Regardless of the fitment between the shell 110 and the insert 112, the insert 112 may be configured such that the clip 104 is substantially flush with the front and rear sides of the main body 102 when mounted.

The insert 112 may be manufactured using a material that is more pliable or elastic than the shell 110. For example, in some embodiments, the insert 112 may be manufactured using semi-crystalline plastic, such as polyamides or nylon. In other embodiments, the insert 112 may be manufactured using thermoplastics, such as polyoxymethylene or Delrin® available from Du Pont De Nemours and Company. Still other embodiments may include manufacturing the insert 112 from compounds such as acrylonitrile butadiene styrene (ABS), polytetrafluoroethylene (PTFE), polycarbonates, or combinations thereof.

Although the shell 110 and the insert 112 are described herein as two separate pieces manufactured using two separate materials, some embodiments include manufacturing the shell 110 and the insert 112 as a single piece. For example, the shell 110 and insert 112 may be manufactured using an extrusion process where the raw stock material is polycarbonate.

Referring still to FIG. 1C, the insert 112 includes protrusions or projections 112A that seat the insert 112 to a plurality of notches or recesses 108A within the rail 108. This seating defines a bearing surface between the projections 112A and the recesses 108A. In the illustrated embodiment, the recesses 108A are configured such that the face of each recess 108A is oriented substantially parallel to the face of the main body 102 and the projections 112A are molded to match this configuration. The insert 112 also may include an opening or passage 112B so as to provide space between a top portion 108B of the rail 108 and the insert 112. The shell 110 also includes a plurality of protrusions or projections 110A that define a plurality of passages between the shell 110 and a corresponding plurality of notches or recesses 102A on the front and rear sides of the main body 102. As shown, the recesses 102A in the main body 102 may be angularly configured to match the angular shape of the projections 110A while maintaining the passage between the shell 110 and the recesses 102A. In the illustrated embodiment, the recesses 102A, the shell 110, and insert 112 (and their corresponding projections 110A and 112A), are symmetric about the center of the rail 108 indicated by line 113. Other embodiments may include various arrangements where the recesses 102A, the shell 110, the projections 110A, the insert 112, and/or the projections 112A are asymmetrically arranged about the line 113. This is illustrated in FIG. 2A.

Figure 2A:
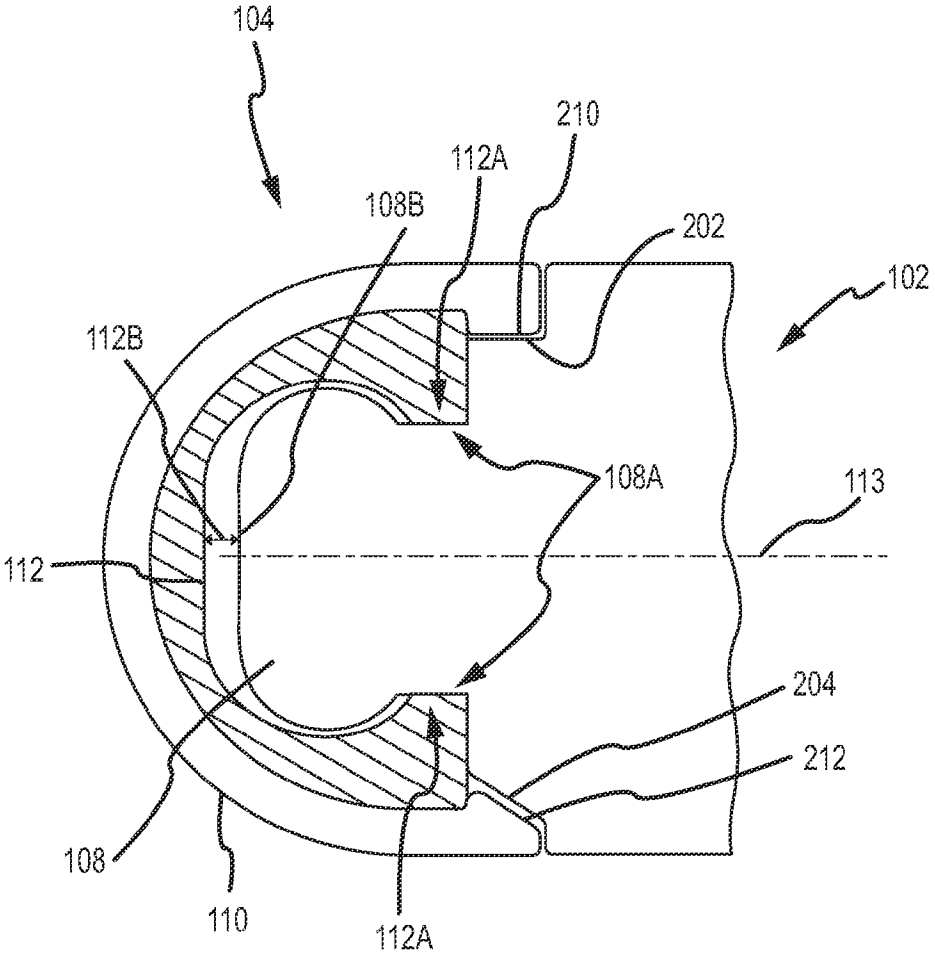
FIG. 2A shows a rail of the electronic device with asymmetric portions.

Referring to FIG. 2A, the main body 102 includes notches or recesses 202 and 204 that are asymmetric about line 113 and the shell 110 includes a plurality of protrusions or projections 210 and 212 that are asymmetrical about the line 113, where projection 210 is generally square and projection 212 is generally angled. In this embodiment, the recess 202 is square shaped while the recess 204 is angled. As will be described in greater detail below with regard to FIG. 6B, this asymmetric configuration of the recesses 202 and 204 may allow the clip 104 to be attached and/or detached from the main body 102 in a unidirectional way, thereby assuring that the clip 104 is not accidentally put on backwards.

Figure 2B:
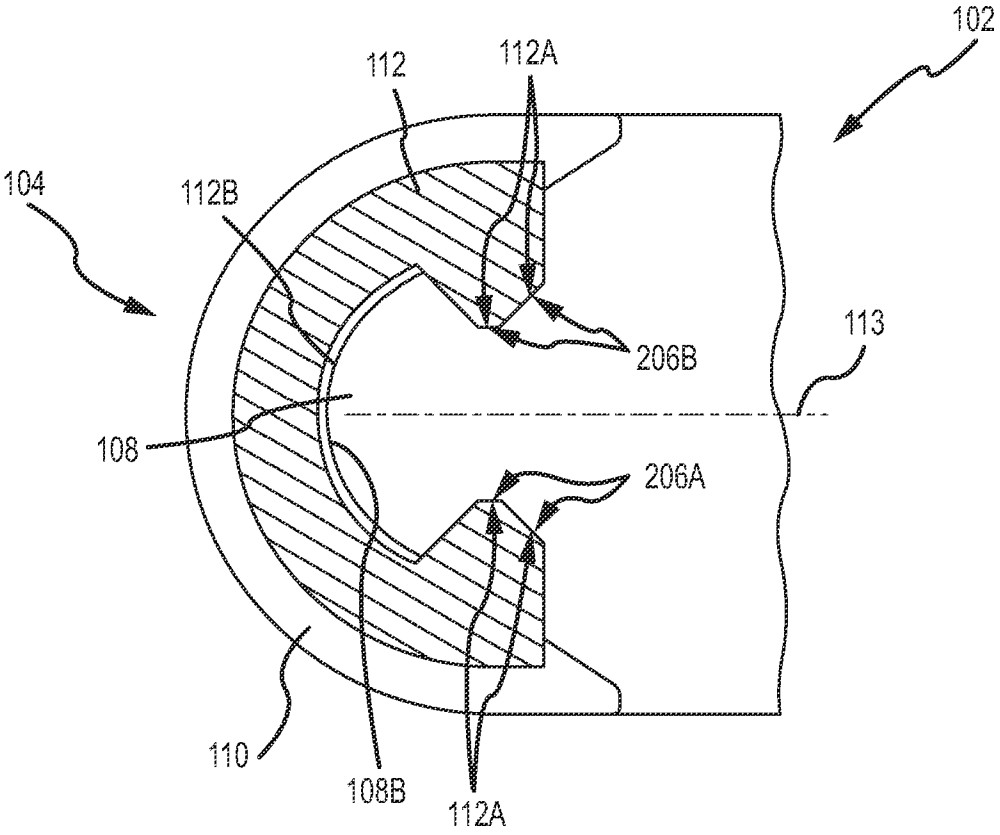
FIG. 2B shows an alternate embodiment of the rail of the electronic device with asymmetric portions.

In the embodiments shown in FIGS. 1A-C and 2A, the rail 108 is "dog bone" shaped and the insert 112 is molded to substantially match this dog bone shape. Other embodiments are possible with different shapes for the rail 108. For example, FIG. 2B shows the rail 108 having notches or recesses 206A and 206B that each comprise multiple parts, where each of the parts may be angularly positioned with respect to the face of the main body 102. As was the case for the embodiment shown in FIG. 2A, the insert 112 shown in FIG. 2B may be molded so that projections 112A substantially match the multiple angles of the recesses 206A and 206B of the rail 108 to define a bearing surface. Also, as was the case for the embodiment shown in FIG. 2A, the insert 112 shown in FIG. 2B may be molded so that the passage 112B between the top portion 108B of the rail 108 and the insert 112 is maintained.

Referring back to FIGS. 1B and 1C, the rear side of the electronic device will now be described. As shown in FIGS. 1B and 1C, the clip 104 further includes a tab, strip, or tongue 114 that extends in a direction substantially parallel to the line 113. This tongue 114 assists in stabilizing the clip 104 and helps prevent strain on the rail 108. In the illustrated embodiment, the tongue 114 and the clip 104 are constructed as a single unitary piece, however other embodiments include forming the clip 104 and the tongue 114 separately and then coupling them together with a fastener, such as with a rivet or a weld joint.

Figure 1D:
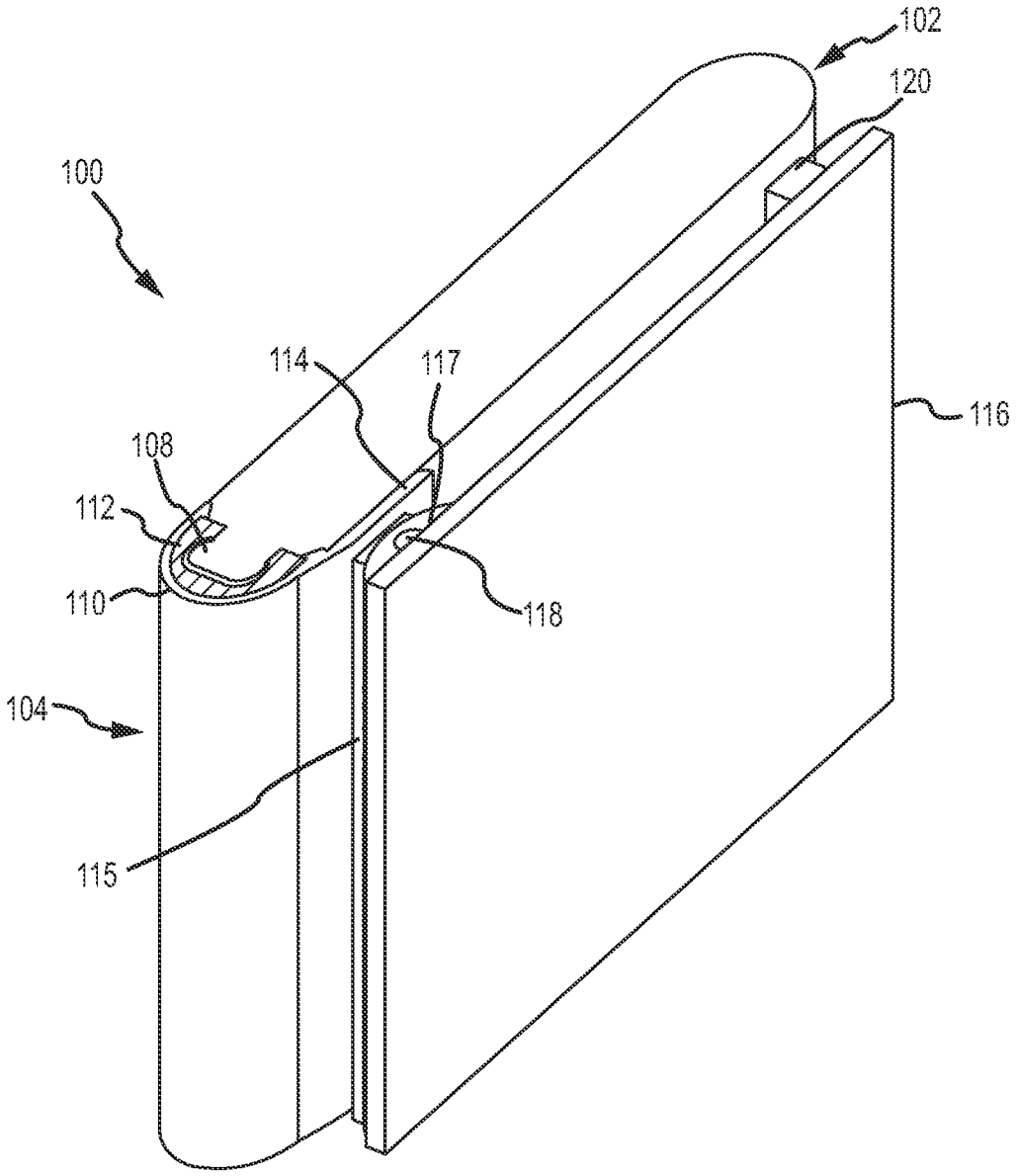
FIG. 1D shows a side perspective view of the electronic device.

As shown in FIG. 1C, the tongue 114 includes a protrusion or projection 115. In the illustrated embodiment, the projection 115 is metallic and may be fastened to the tongue 114 in several ways. For example, the projection may be welded to the tongue 114 and/or attached with a screw that runs through the tongue 114 into the projection 115. The metal used in forming the projection 115 may be the same as the tongue 114 (e.g., aluminum or stainless steel) or different depending upon the embodiment. FIG. 1D illustrates a side perspective view of the electronic device 100 showing the projection 115 in greater detail. Referring to FIGS. 1C and 1D, in the illustrated embodiment, the projection 115 may be fastened to the tongue 114 in a substantially perpendicular fashion, however, other embodiments are also possible where the projection 115 is tilted with respect to the tongue 114. Regardless of the angular orientation between the projection 115 and the tongue 114, the projection 115 may couple the tongue 114 to a metallic latch, hasp, or catch 116 to a projection 117 via a hinge or joint 118. The metal used in forming the projection 117 or the joint 118 may be the same as the catch 116 (e.g., aluminum or stainless steel) or different depending upon the embodiment ultimately implemented. Further, the projection 117 may be manufactured with the catch 116 or they may be manufactured in two separate pieces and later fastened together. As will be described in greater detail below with regard to FIG. 8A, the combination of the catch 116 and projection 117 rotates angularly about the joint 118.

The joint 118 also may be integrally formed as part of the catch 116 or formed separately and then welded to the catch 116. Further, although the embodiment shown in FIG. 1D illustrates the projection 115 as a single unitary piece, other embodiments are possible where the projection 115 exists as multiple pieces. For example, the projection 115 and the joint 118 may interface with each other to form a "knuckle" type joint. The joint 118 may be spring loaded, so that in the neutral position, the catch 116 is biased toward the rear side of the main body 102. The catch 116 also includes a tab 120 that is fastened to the catch 116 at the opposite end of the catch 116 than the projection 115. The tab 120 may be fastened to the catch 116, for example, by welding the tab 120 to the catch 116 or riveting them together. In these embodiments, the tab 120 may be metal, such as aluminum and/or stainless steel. In other embodiments, the tab 120 is rubber or plastic and may be fastened to the catch 116 using adhesive.

When the catch 116 is in the neutral position, the catch 116 may contact the main body 102 via the tab 120. In the illustrated embodiment, the thickness of the tab 120 is substantially the same as the thickness of the projection 115 so that the catch 116 rests substantially parallel to the rear side of the main body 102. As will be described in greater detail below with regard to FIGS. 8A-8C, the catch 116 may engage various objects to secure the main body 102 and allow the electronic device 100 to be worn by a user.

Figure 1E:
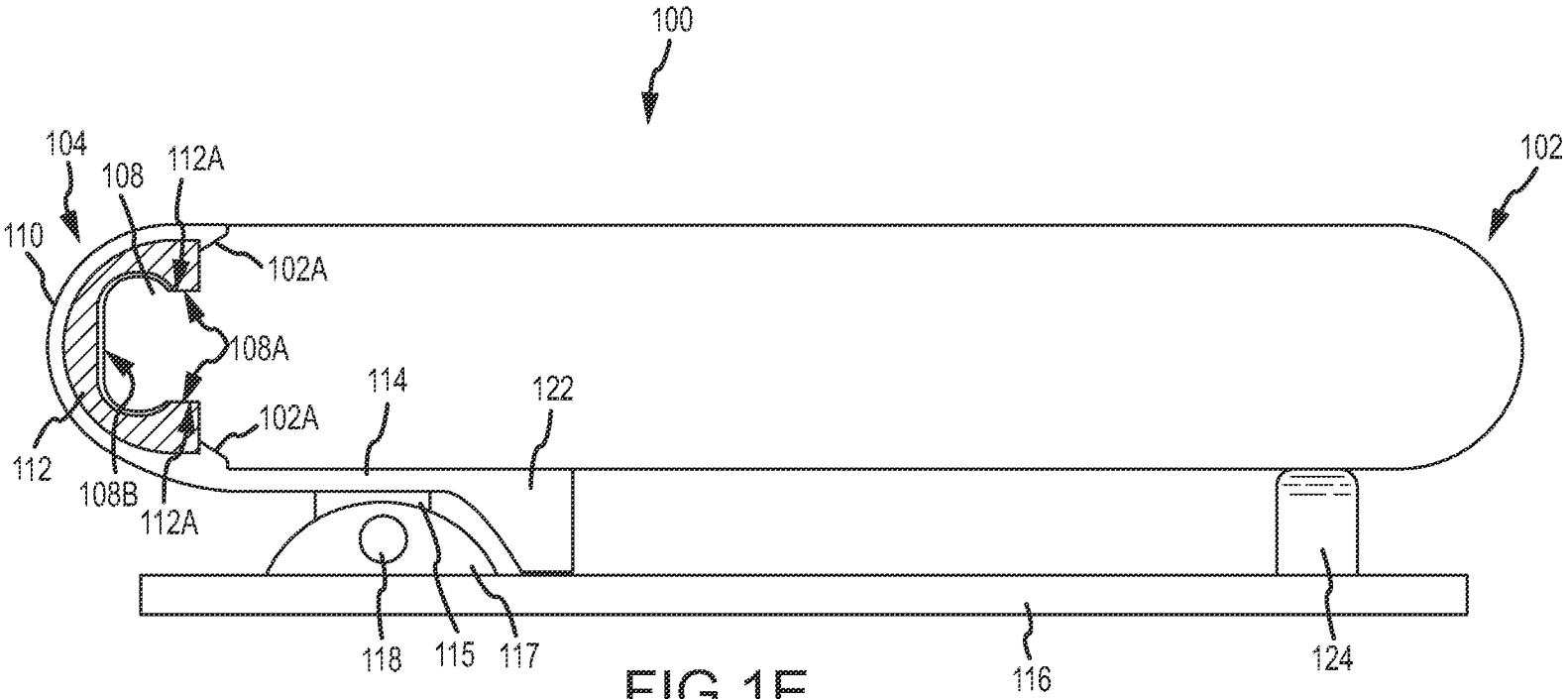
FIG. 1E shows a top down view of the electronic device with alternate resting points for a catch.

Although the embodiment illustrated in FIG. 1D shows the catch 116 resting only upon the tab 120, other embodiments are possible where the catch 116 rests upon other structures. For example, FIG. 1E illustrates a top down view of an alternative resting points for the catch 116. Referring momentarily to the embodiment of FIG. 1E, the tongue 114 includes a stay or stop 122 that is manufactured along with the tongue 114 and the clip 104. In the neutral position, the catch 116 may rest on the stop 122 as well as a tab 124. Note that the tab 124 shown in FIG. 1E is more rounded than the tab 120 shown in FIG. 1C. Rounding the tab 124 may allow the clip 104 to be inserted onto the body 102 without catching the edge of the tab 124 on the body 102 as the clip 104 is slid onto the body 102.

Figure 3A:
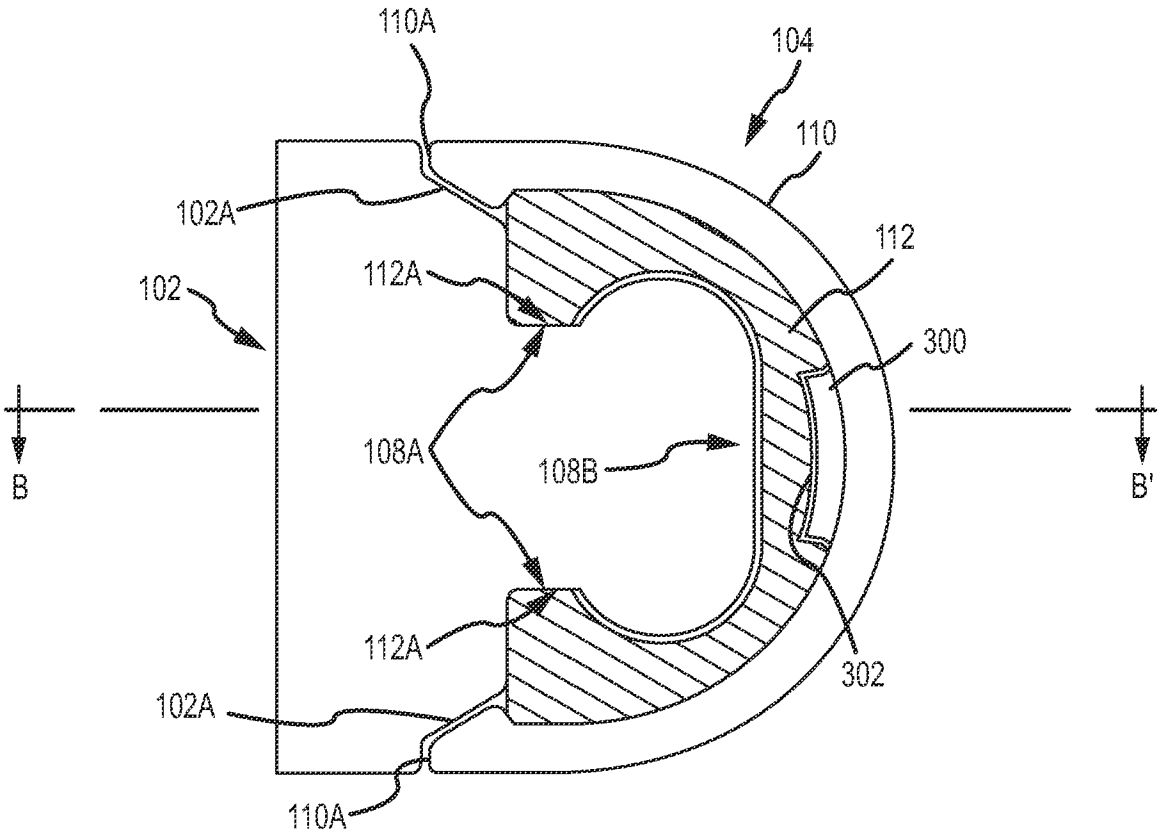
FIG. 3A shows a cross sectional view of the rail and a clip attached to the rail.
Figure 3B:
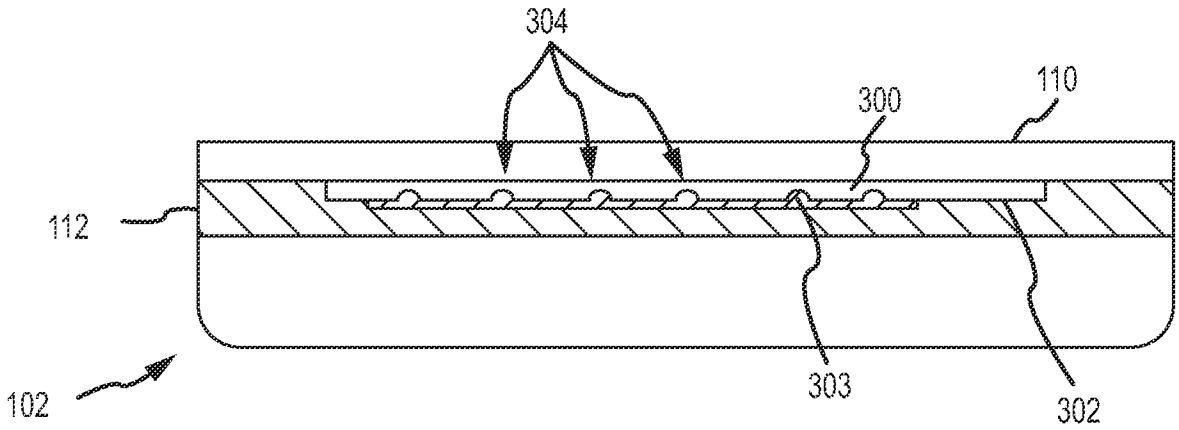
FIG. 3B shows another cross sectional view of the rail and the clip.

Referring again to FIGS. 1A and 1B, a section line AA' is shown through the rail 108 and the clip 104. FIG. 3A shows a cross sectional view of the rail 108 and the clip 104 taken along the section line AA' to illustrate the manufacture of the clip 104. For ease of discussion, the tongue 114 is not shown. Referring now to FIG. 3A, the insert 112 may be fitted within the interior of the shell 110 using a stay or stop 300. A section line BB' is shown in FIG. 3A through the rail 108 and the clip 104 at the location of the stop 300. FIG. 3B illustrates a cross sectional view of the rail 108, clip 104, and stop 300 taken along the section line BB'. Referring to FIGS. 3A and 3B, the stop 300 may be fastened to the interior of the shell 110 in a location that corresponds with a notch or recess 302 formed in the insert 112. As will be discussed further in FIG. 5, in some embodiments, the stop 300 is made from the same material as the shell 110, e.g., aluminum and/or stainless steel, and is welded to the interior of the shell 110. In other embodiments, the stop 300 may be an integral part of the shell 110.

Referring to FIG. 3B, the stop 300 may include a series of cavities or indentations 304. In the illustrated embodiment, the insert 112 is fastened to the shell 110 using an adhesive 303 at the interface between the stop 300 and the insert 112. The adhesive may vary between embodiments depending upon the materials used to fabricate the insert 112 and/or the shell 110. For example, in the embodiments where the insert 112 is made using ABS, the adhesive may be a melted ABS. Other embodiments include using metallic based epoxies. The indentations 304 may provide greater surface area for adherence between the insert 112 and the stop 300. Further, although the indentations 304 are shown as formed within the stop 300, in some embodiment, the indentations may be formed in the recess 302 of the insert 112 and the stop 300 may be flat.

Figure 4:
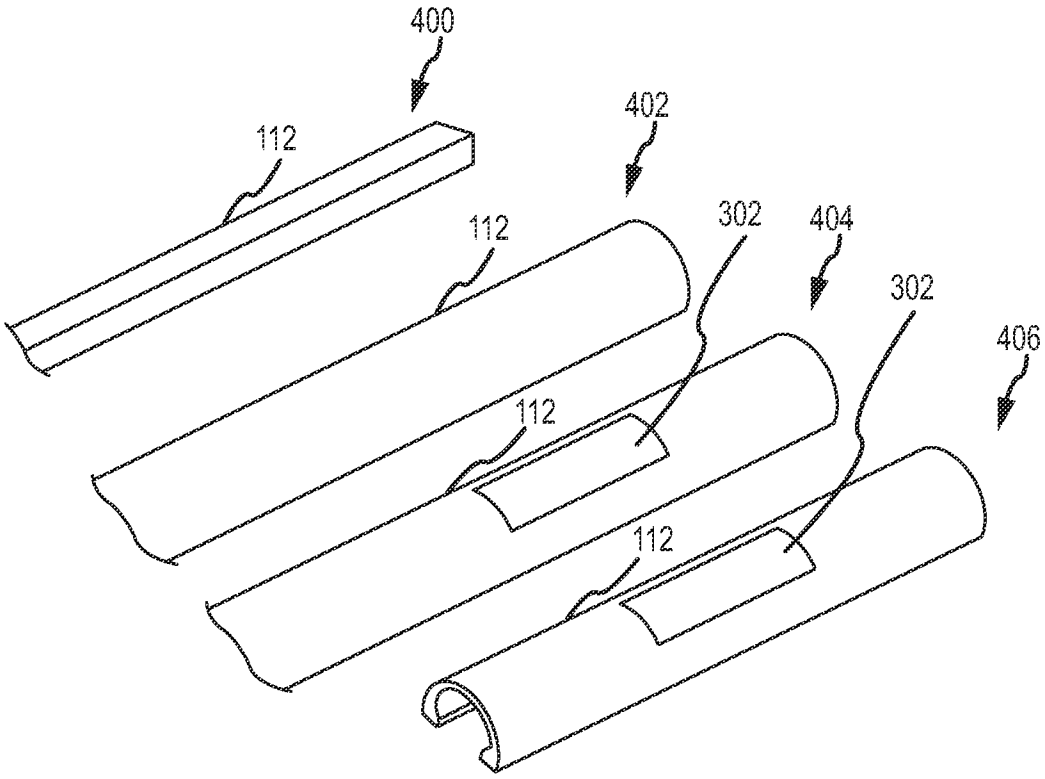
FIG. 4 shows steps that may be used to manufacture an insert portion of the clip.

FIG. 4 illustrates progressive steps 402-406 involved in the manufacture of the insert 112. The steps 402-406 shown in FIG. 4 illustrate one possible sequence for manufacturing the insert 112, however, these steps are not limiting. For example, although the steps 402-406 may be described herein in a particular sequence, they may be performed in any order. Referring now to FIG. 4 in conjunction with FIGS. 3A and 3B, the insert 112 begins with a piece of raw stock at step 400. As was described above, the raw stock 400 may include various materials such as polyamides or nylon, Delrin®, ABS, PTFE, polycarbonates, or combinations thereof. The raw stock may be extruded through a die whose cross section includes a portion that matches the cross sectional pattern of the rail 108 to form an extruded part at step 402. As was discussed previously, the cross section of rail 108 may take many different forms, and the extruded part may match each of the many different forms depending upon the embodiment that is ultimately implemented. In the illustrated embodiment, the extruded part includes a curved exterior matched to the interior of the shell 110.

After extrusion, the recess 302 is formed at step 404. This recess 302 may be formed in a variety of ways. For example, in some embodiments, the recess 302 may be laser etched into the raw stock while other embodiments may include chemical etching, mechanical milling, or combinations thereof. Also, while a single recess 302 is shown, multiple recess 302 and corresponding stops 300 may exist along the lateral dimension of the shell 110. Further, in some embodiments, the recess 302 may run along the entire lateral dimension of the insert 112 in a substantially continuous manner. In these embodiments, the recess 302 may be formed as part of the extrusion process at step 402. Additionally, the indentations described above may be formed in the recess 302 during step 402. After forming the recesses, the insert 112 may be cut to match the length of the shell 110 at step 406.

Figure 5:
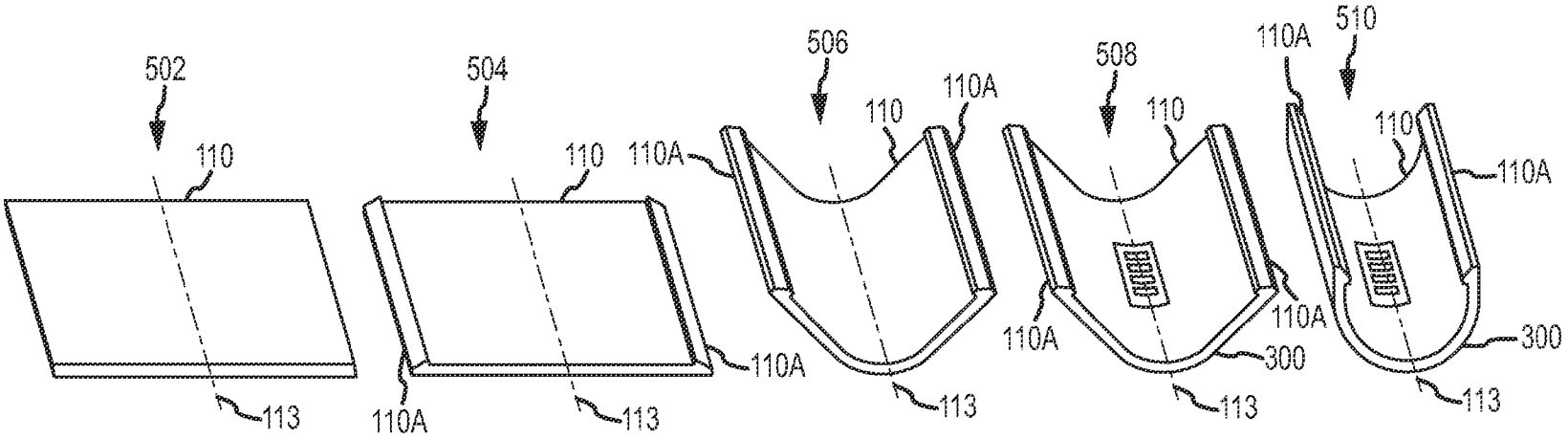
FIG. 5 shows steps that may be used to manufacture a shell portion of the clip.

FIG. 5 illustrates progressive steps 502-510 involved in the manufacture of the shell 110. The steps 502-510 shown in FIG. 5 illustrate one possible sequence for manufacturing the shell 110, however, these steps are not limiting. Also, although specific metal shaping techniques may be discussed herein, techniques such as bending, rolling, extrusion, punching, welding, and/or melting and pouring into molds, may be used depending upon the embodiment ultimately implemented.

Referring now to FIG. 5 in conjunction with FIG. 3A, at step 502, a flat sheet is cut to form the shell 110. (Again, for ease of discussion, the tongue 114 is also not shown in FIG. 5.) As discussed above, in some embodiments, the shell 110 may be metallic and manufactured from the same metal as the main body 102, while in other embodiments, the shell 110 may be manufactured using plastic or plastic composites. Thus, the flat sheet may be metal or plastic depending upon the embodiment ultimately implemented.

At step 504, the flat sheet is stamped to form the projections 110A. In the illustrated embodiment, stamping produces projections 110A that are symmetric about line 113, however, other embodiments are possible where the stamping produces asymmetric projections. After the edges are stamped, the flat sheet is bent to form the bottom of the shell 110 at step 506. This bending in step 506 may occur by forcing the flat sheet around a circular object with an outside diameter approximately equal to the outer curve of the insert 112. Once the bend is in place, the stop 300 is fastened to the bottom of the bend in the shell 110 at step 508. As shown in FIG. 3A, the stop 300 may be slightly curved to match the bend in the shell 110. To finish forming the shell 110, the shell 110 is stamped so that the ends of the shell 110 (where the projections 110A are located) conforms to the overall curvature of the outer curve of the insert 112. This is shown in FIG. 5 at step 510. In some embodiments, the insert 112 including the recess 302 (shown at step 406 of FIG. 4) may be placed into the shell 110 prior to performing the bending of step 510. In other embodiments, such as the embodiments where the recess 302 runs the entire length of the insert 112, the insert 112 may be placed into the shell 110 after the bending of step 510.

Figure 6A:
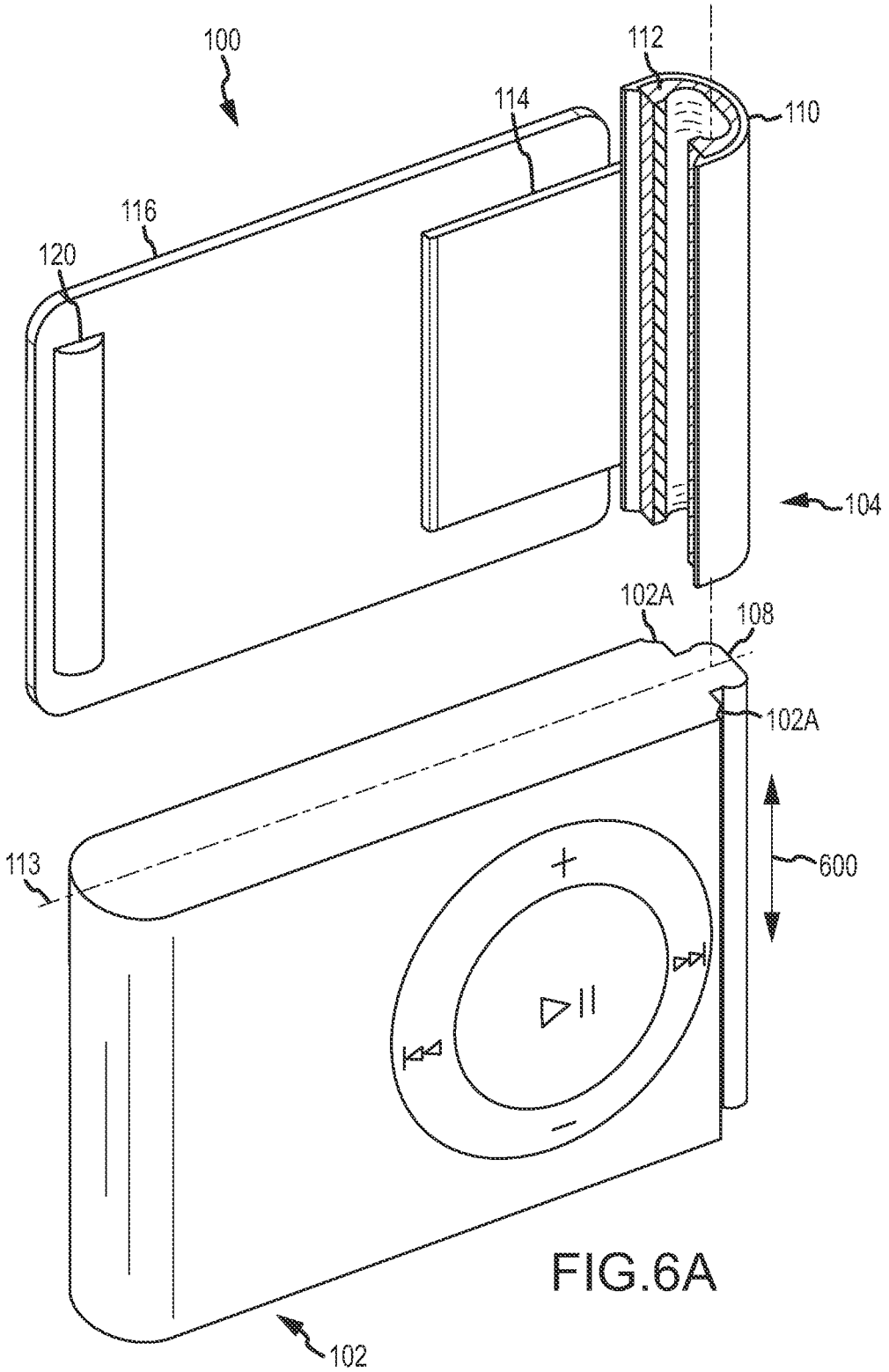
FIG. 6A shows a perspective view of the electronic device with the clip detached.

FIGS. 6A, 6B, 7A, 7B, and 8A-8C illustrate the functionality of the clip 104. Referring first to FIG. 6A, a perspective view of the electronic device 100 is shown with the clip 104 detached from the main body. The clip 104 may detach from the main body 102 by sliding off of the rail 108 in a direction that is parallel to the lateral dimension of the rail 108 as illustrated by a line 600. In the illustrated embodiment, the rail 108 is bidirectional and clip 104 may slide off the rail 108 by applying force to the clip 104 in either the up or down directions as illustrated by the line 600 being double sided. Similarly, the clip 104 may re-attach to the main body 102 by sliding onto the rail in either of these directions.

The amount of force that is sufficient to detach the clip 104 from the main body 102 may vary based upon the materials chosen for the shell 110 and the insert 112. The term "peak force," as used here, refers to the amount of force that is to be applied to the clip 104 to begin movement along the rail 108. In order to keep the clip 104 in place when attached to the main body 102, this peak force should be relatively high, but not so high that a user would not be able to detach the clip 104 at all. In some embodiments, such as when the insert 112 is manufactured using Delrin® and the shell 110 is manufactured using stainless steel, the peak force is approximately 700 grams of force. In other embodiments, such as when the insert 112 is manufactured using ABS and the shell 110 is manufactured using stainless steel, the peak force is approximately 500 grams of force.

The term "dynamic force," as used herein, refers to the amount of force that is to be applied to the clip 104 to continue its movement along the rail 108 after the peak force has been applied. In order to keep the clip 104 moving once the peak force has been met, this dynamic force should be lower than the peak force, but not so low that the clip 104 detaches from the rail 108 too easily (e.g., falls off the rail 108 after the peak force is met). The term "friction ratio," as used herein, refers to the ratio between the peak force and the dynamic force. The dynamic force and friction ratios depend upon the materials chosen for the shell 110 and the insert 112. In the embodiments where the insert 112 is manufactured using Delrin® and the shell 110 is manufactured using stainless steel, the dynamic force is between about 500 and 550 grams of force and the friction ratio is approximately 1.3. In the embodiments where the insert 112 is manufactured using ABS and the shell 110 is manufactured using stainless steel, the dynamic force is between about 100 and 150 grams of force and the friction ratio is approximately 2.2. Based upon testing it is believed that a friction ratios from about 2.2 on up provide the desired balance of dynamic to peak forces for a user to interact with the clip 104. Of course the materials chosen for the shell 110 and the insert 112 may vary between embodiments such that the friction ratio is well below 2.2 or well above 2.2.

Referring still to FIG. 6A, in the embodiment illustrated, the main body 102 includes recesses 102A that are symmetric about the line 113. As was discussed above with regard to FIG. 2A, other embodiments are possible where the recesses 202 and 204 are asymmetrically arranged about the line 113. In these embodiments, the clip 104 slid onto the rail 108 in a unidirectional manner. This is shown in FIG. 6B.

Figure 6B:
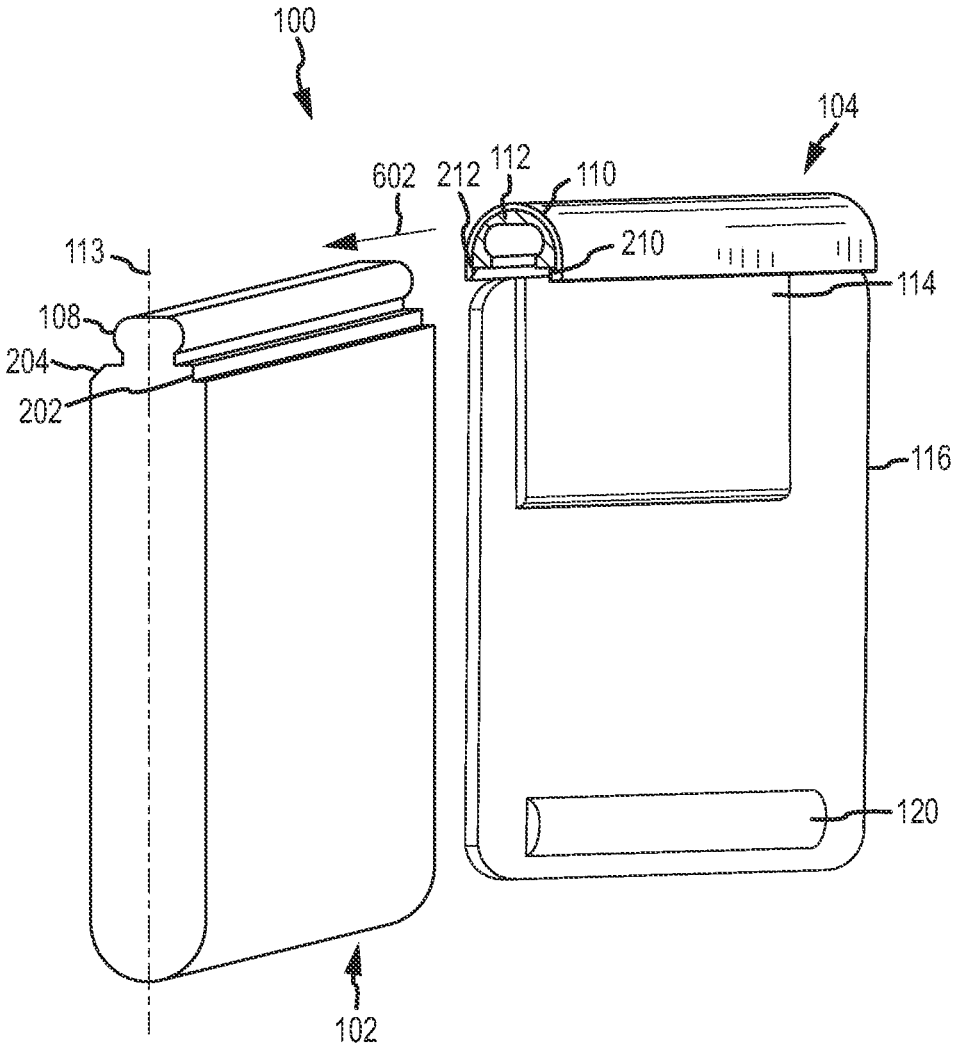
FIG. 6B shows a perspective view of an alternate embodiment of the electronic device with the clip detached.

Referring now to FIGS. 6B, a perspective view is shown of the clip 104 attaching to the rail 108 when the recesses 202 and 204 are asymmetrical. Arrow 602 illustrates the path of travel of the clip 104. As the clip 104 makes initial contact with the rail 108 the square projection 210 makes contact with the square recess 202 while the angled projection 212 makes contact with the angled recess 204. After making initial contact with the rail 108, the projection 210 begins to slide along the recess 202 while the clip 104 is advanced. Because the embodiment shown in FIG. 1C allow the potential for mounting the clip 104 on the body 102 backwards, e.g., with the catch 116 covering the interface, the asymmetrical embodiment shown in FIGS. 2A and 6B may alleviate this problem by providing unidirectional operation.

Figure 7A:
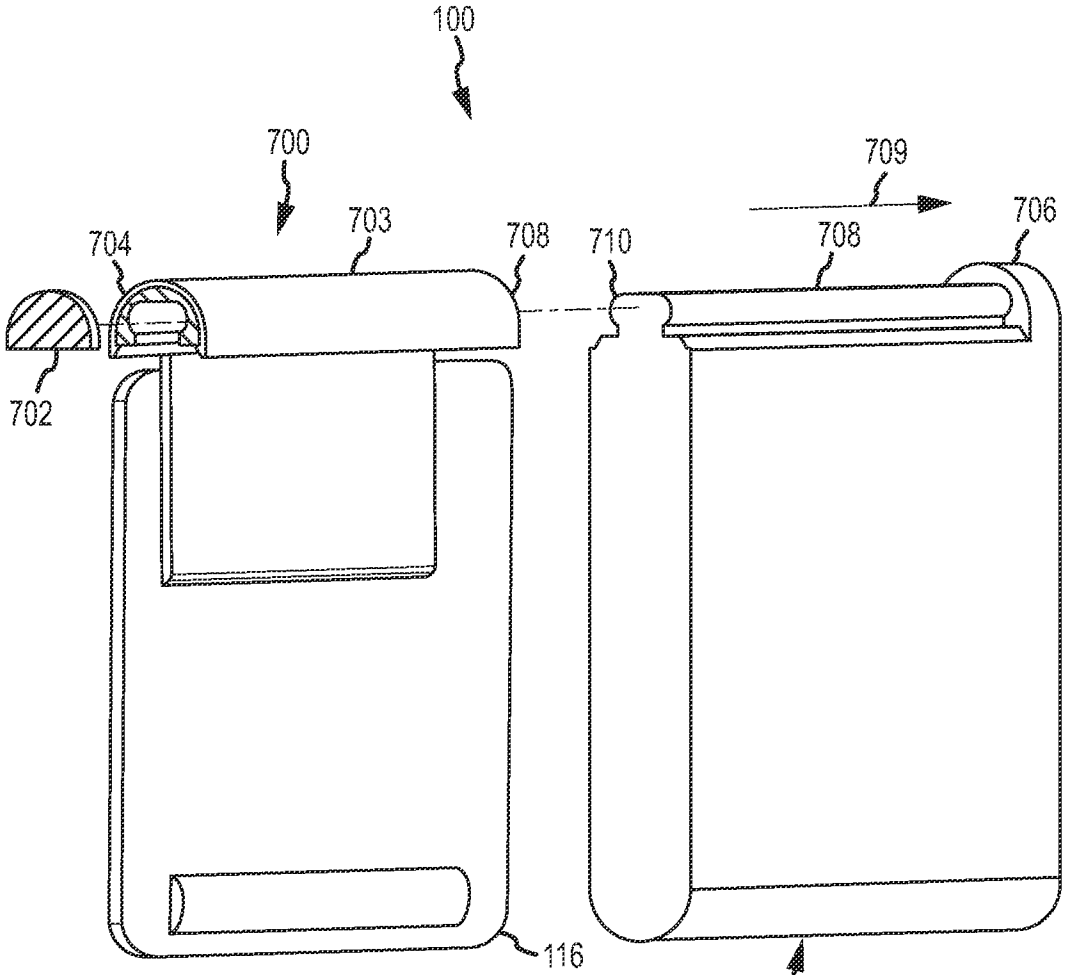
FIG. 7A shows a perspective rear view of the rail and the clip according to an alternate embodiment.
Figure 7B:
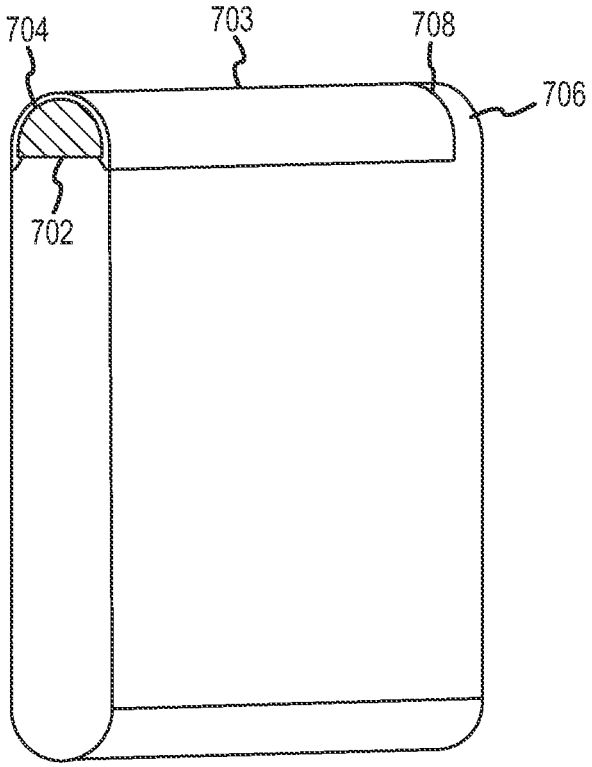
FIG. 7B shows the alternate embodiment of FIG. 7A with the clip mounted to the rail.

As shown in FIGS. 6A and 6B, some embodiments include the ability for the clip 104 to be slid on and off the rail 108 in both directions of the rail 108. FIGS. 7A and 7B illustrate alternate embodiments where the clip 104 may be slid on and off the rail 108 in a single direction.

Referring first to FIG. 7A a perspective rear view of a clip 700 and the main body 102 is shown. The clip 700 includes a cover or cap 702 coupled to the clip 700. In the illustrated embodiment, the cap 702 is manufactured from the same material as the clip 700, such as aluminum or stainless steel, however other embodiments are possible where the cap 702 is manufactured using different materials, such as plastic or ABS. As was discussed previously with regard to other embodiments, the clip 700 may include an outer structure, framework, or shell 703 and an insert within the shell 703 (not specifically shown). This insert and the rail 108 may create a bearing surface for the clip 700 to move along when being attached or detached from the main body 102. In the illustrated embodiment, this insert is set back from a near end 704 of the shell 703 to allow the cap 702 to be press fit into the shell 703 and sit flush with the near end 704 of the shell 703. In some embodiments, the cap 702 may include projections (not specifically shown) that are keyed to match the profile of the rail 108 so that the cap 702 seats into the near end 704 of the shell 703 as well as into the insert within the shell 703.

The rail 108 includes a stop or stay 706. The die used to form the rail 108 and the main body 102 may include a section that defines the stay 706 so that the stay 706 is formed substantially contemporaneous to forming the main body 102 and rail 108. As was the case with the rail 108, forming the stay 706 as part of the overall extrusion process used in forming the main body 102 reduces the overall cost and complexity of manufacturing the stay 706.

Referring still to FIG. 7A, during operation, the clip 700 may be attached to the main body 102 in the direction of the arrow 709. Once attached, the clip 700 may seat against the stay 706 such that a far end 708 of the shell 703 sits substantially flush with the stay 706 when the clip 700 is attached to the main body 102 and the cap 702 sits substantially flush with a near end 710 of the rail 108. This is shown in FIG. 7B. Since the cap 702, the shell 703, and the stay 706 may be manufactured using the same material as the main body 102, the embodiment shown in FIGS. 7A and 7B may be more aesthetically pleasing than other embodiments where the insert is visible.

Figure 8A:
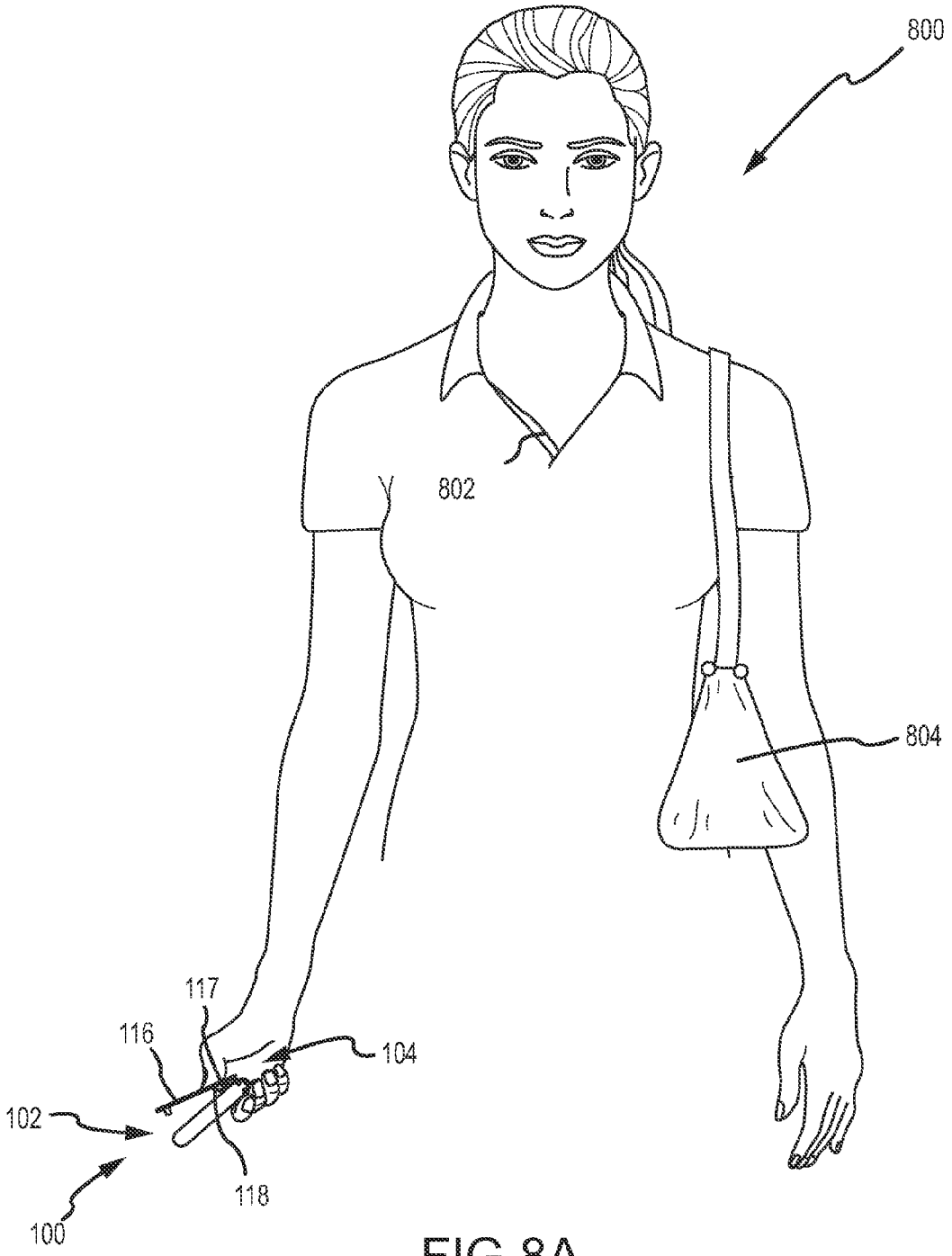
FIGS. 8A-8C show a user attaching the electronic device to clothing and then detaching the clip from the rail.
Figure 8B:
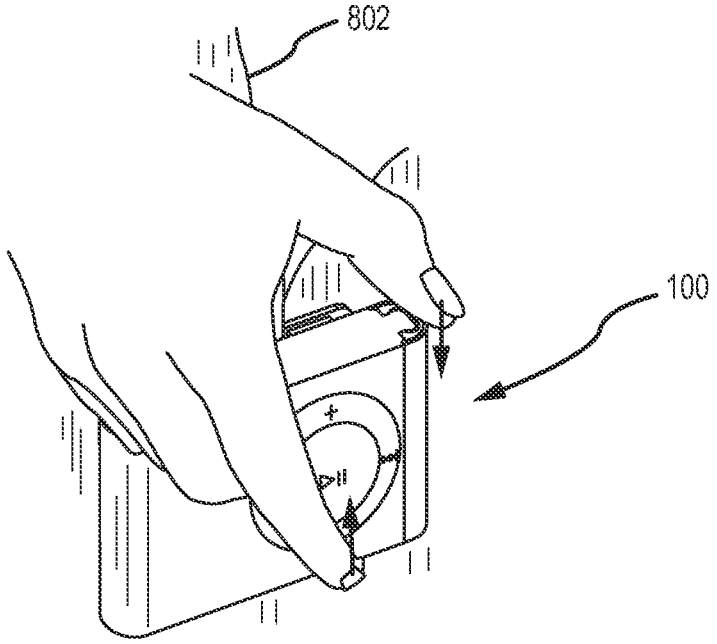
Figure 8C:
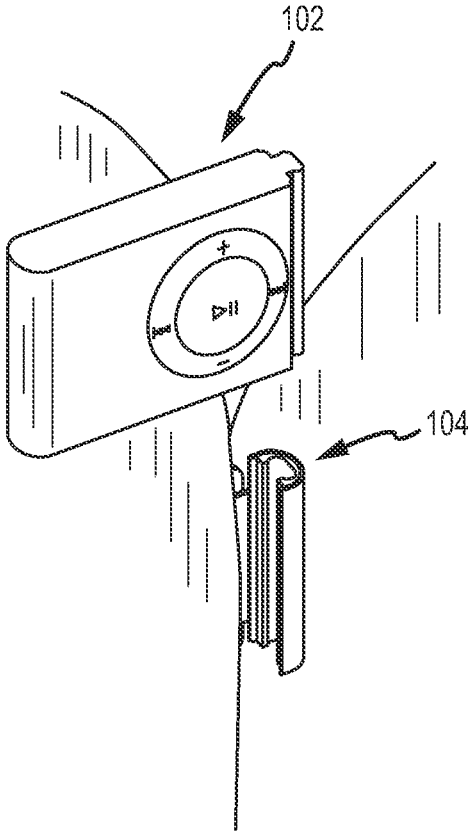

FIGS. 8A-8C illustrate a user operating the electronic device 100. Referring first to FIG. 8A, the electronic device 100 is shown with the main body 102 detachably coupled to the clip 104. A user 800 may depress the catch 116 near the joint 118 to open the catch 116 from the neutral position. Once opened the user may attach the electronic device 100 to a loose article of clothing 802, such as a lapel, or a personal item 804, such as a purse. FIG. 8B shows the electronic device 100 attached to clothing 802.

Referring now to FIG. 8B, a user may apply force against the main body 102 and clip 104 to detach the main body 102 from the clip 104. For example, in the embodiments where the clip 104 and the main body 102 move in both directions of the rail 108, such as the embodiments shown in FIGS. 6A and 6B, the user 800 may apply opposing forces to the main body 102 and the clip 104 using the index finger and thumb of a single hand. Thus, the main body 102 and clip 104 may be separated using single handed operation in some embodiments. In other embodiments, such as the embodiment shown in FIGS. 7A and 7B, two handed operation may be necessary to separate the main body 102 from the clip 104. In any event, once the main body 102 is separated from the clip 104 the user 800 may place the main body in their pocket without the added bulk from the clip 104. This is shown in FIG. 8C. The clip 104 then may be stored separately, such as in the purse 804 (shown in FIG. 8A).

While the rail 108 has been described in the context of a detachable clip 104, the rail 108 may be used to detachably couple the electronic device 100 to a variety of consumer electronic devices as shown in FIGS. 9A-9D.

Figure 9A:
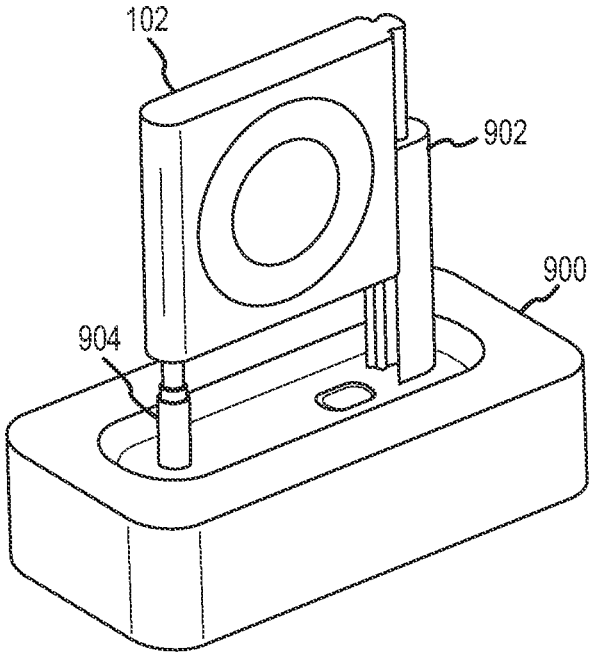
FIGS. 9A-9D show the electronic device detachably coupled to a variety of consumer electronic devices.

Referring first to FIG. 9A, a charging station 900 for charging the internal battery within the main body 102 is shown. The charging station 900 includes a rail 902 that is similar to the rail 108 described above. The charging station 900 further may include an electrode 904 that makes contact with circuitry within the main body 102 as the main body 102 is slid onto the rail 902. In this manner the rail 902 may provide structural support so that if pressure is applied to the main body 102, the electrode 904 does not break off.

Figure 9B:
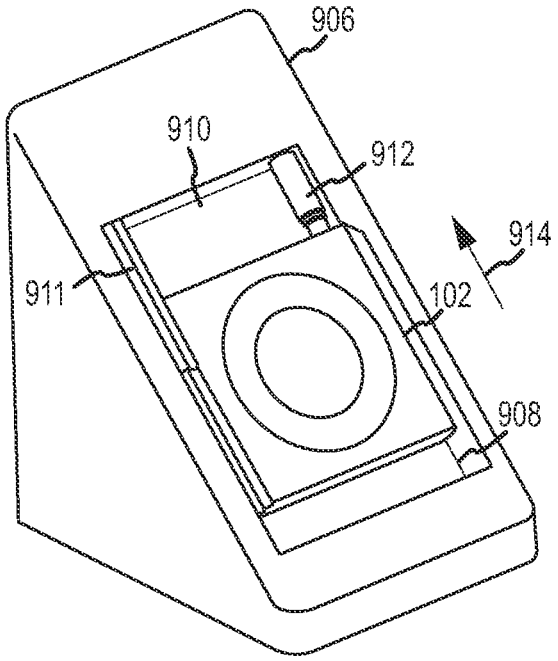

Referring now to FIG. 9B, the main body 102 is shown mounted to a pedestal 906. Although not specifically shown, the pedestal 906 may couple to a computer that is used to transfer audio files to and/or from the main body 102. The pedestal also may be used to charge internal batteries within the main body 102. The pedestal 906 may include a multi-part recess comprising lower recess 908 and upper recess 910. The upper recess 910 may include a rail 911 and an electrode 912. During operation, the main body 102 may be initially placed into the lower recess 908 where it makes initial contact with the rail 911 on one side of the pedestal 906 and the electrode 912 on the other side of the pedestal 906. The main body 102 then may be advanced in the direction of the arrow 914 such into the upper recess 910. As the main body 102 advances in the direction of the arrow 914, the main body 102 may engage both the rail 911 and the electrode 912, thereby securing the main body 102 to the pedestal 906.

Figure 9C:
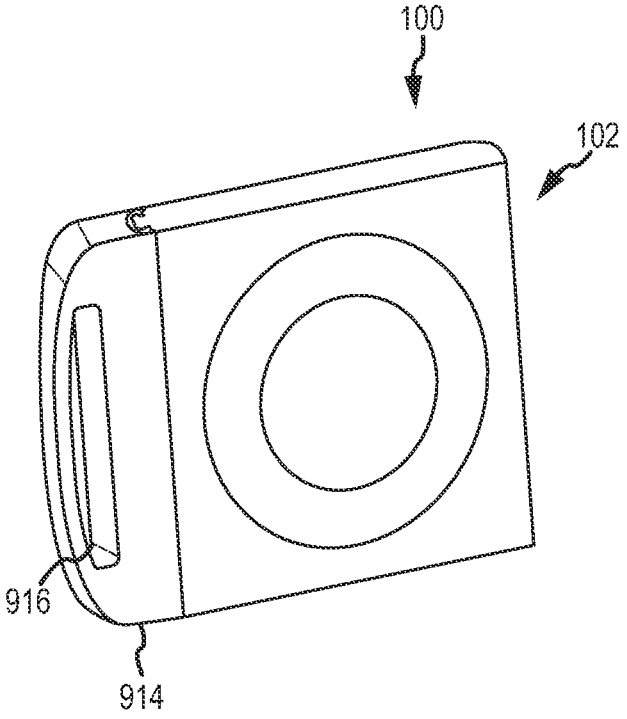

Referring now to FIG. 9C, the main body 102 is shown coupled to a detachable lanyard 914. The lanyard 914 includes a slot 916 for connecting the electronic device 100 to a keychain, the strap of a backpack, or a user's belt loop to name but a few items.

Figure 9D:
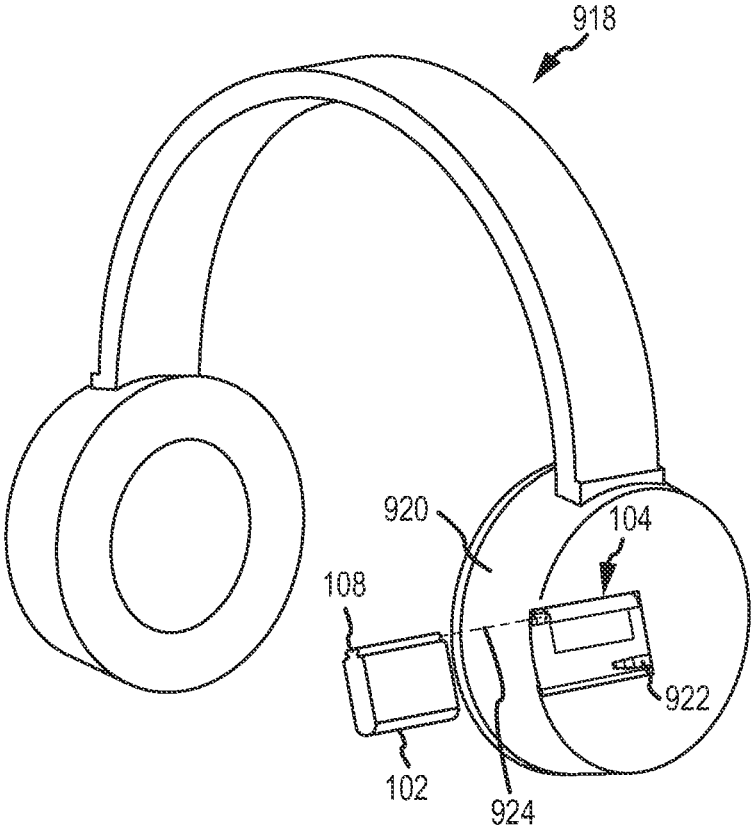

Referring now to FIG. 9D, a pair of headphones 918 is shown with the clip 104 recessed into assembly 920 of the headphones 918. In some embodiments, the assembly 920 is the left headphone and in other embodiments the assembly 920 is the right headphone. The assembly 920 also may include an electrode 922. The main body 102 slides into the assembly along the path defined by the lead line 924 so that the rail 108 slides into the clip 104 and makes contact with the electrode 922.

The invention claimed is:

1. A wearable electronic device, comprising:

a main body, comprising:

a user interface positioned on a first side of the main body, a first edge, a second edge opposite the first edge, a first recess extending at least from the first edge to the second edge, and a second recess separated from the first recess by a portion of the main body that is positioned between the first recess and the second recess, the second recess extending at least from the first edge to the second edge; and an attachment mechanism configured to attach the main body to a user, the attachment mechanism comprising:

a component releasably coupled to the main body, an insert attached to an inner side of the component, a first protrusion extended from the component and that slides along the main body from the first edge to the second edge to mate with the first recess, and a second protrusion extended from the component and that slides along the main body from the first edge to the second edge to mate with the second recess.

2. The wearable electronic device of claim 1, wherein the main body includes a lateral dimension defined from the first edge to the second edge, and wherein the first protrusion includes a dimension corresponding to the lateral dimension.

3. The wearable electronic device of claim 1, wherein the first protrusion includes a first shape, and wherein the first recess includes a second shape that corresponds to the first shape.

4. The wearable electronic device of claim 1, wherein the attachment mechanism comprises a polymeric material.

5. The wearable electronic device of claim 4, wherein the polymeric material comprises a thermoplastic polymer.

6. The wearable electronic device of claim 1, wherein the first recess and the second recess are diagonally configured to match an angular shape of the first protrusion and the second protrusion, respectively.

7. The wearable electronic device of claim 1, wherein the user interface is located between the first recess and the second recess.

8. The wearable electronic device of claim 1, wherein the first recess and the second recess are symmetric about the portion of the main body.

9. The wearable electronic device of claim 1, wherein the main body comprises circuitry such that the user interface configured to control the circuitry.

10. An attachment mechanism that releasably attaches with a wearable electronic device and is configured to secure the wearable electronic device with a user, the wearable electronic device including a first recess and a second recess separated from the first recess by a portion of the wearable electronic device, the attachment mechanism comprising:

a body portion having a first projection and a second projection that is opposite the first projection;

a first insert portion extending from the body portion and located proximate to the first projection; and a second insert portion extending from the body portion and located proximate to the second projection, wherein when the body portion slides relative to, and secures with, the wearable electronic device i) the first projection is positioned in the first recess and the first insert portion engages the wearable electronic device at a third recess of the wearable electronic device, and ii) the second projection is positioned in the second recess and the second insert portion engages the wearable electronic device at a fourth recess of the wearable electronic device.

11. The attachment mechanism of claim 10, wherein the first projection includes a first material, and wherein the first insert portion includes a second material different from the first material.

12. The attachment mechanism of claim 10, wherein the first projection and the second projection positioned in the first recess and the second recess, respectively, define a user attachment system that secures the wearable electronic device to the user.

13. The attachment mechanism of claim 12, wherein the user attachment system surrounds a portion of the wearable electronic device.

14. The attachment mechanism of claim 10, wherein the first projection includes a metal mixed with a polymeric material.

15. The attachment mechanism of claim 10, further comprising:

a stop; and a recess, wherein when the first projection is positioned in the first recess, the stop is aligned with the recess.

16. The attachment mechanism of claim 10, wherein the first recess includes a first shape, and wherein the first projection comprises a second shape corresponding to the first shape.

17. A wearable electronic device configured to secure with an attachment mechanism, the attachment mechanism including a first protrusion having a first insert portion and a second protrusion having a second insert portion, the wearable electronic device comprising:

a body comprising:

a user interface positioned on a first side of the body, a first recess located at a first end and proximate to the first side, the first recess having a first curved surface corresponding to a curvature of the first protrusion and the first insert portion such that the first recess is capable of receiving the first protrusion and the first insert portion, and a second recess located at a second end opposite the first end, the second recess having a second curved surface corresponding to a curvature of the second protrusion formed by the second insert portion such that the second recess is capable of receiving the second protrusion and the first insert portion, and a body portion that separates and is positioned between the first recess and the second recess.

18. The wearable electronic device of claim 17, wherein the first projection and the second projection are molded to match the curvature of the first curved surface and the second curved surface, respectively.

19. The wearable electronic device of claim 17, wherein the first recess and the second recess are diagonally configured to match an angular shape of the first protrusion and the second protrusion, respectively.

20. The wearable electronic device of claim 17, wherein the first recess and the second recess are symmetric about a portion of the body portion.

21. The wearable electronic device of claim 17, further comprising:

electronic circuitry that is used by the user interface to control the electronic circuitry.

22. The wearable electronic device of claim 17, wherein the user interfaces comprises a button and a switch.

23. The wearable electronic device of claim 17, wherein the body extends from a first edge to a second edge, and wherein the first recess and the second recess extend from the first edge to the second edge.

* * * * *